US005277088A

United States Patent [19]

Vasichek et al.

[11] Patent Number: 5,277,088

[45] Date of Patent: * Jan. 11, 1994

[54] MAGNETIC KEEPER ACCESSORY FOR WRENCH SOCKETS

[76] Inventors: Richard A. Vasichek, HCR, Box 30, Brocket, N. Dak. 58321; Robert J. Vasichek, R.R. #1, Box 77, Michigan, N. Dak. 58259

[ * ] Notice: The portion of the term of this patent subsequent to Sep. 15, 2009 has been disclaimed.

[21] Appl. No.: 2,210

[22] Filed: Jan. 8, 1993

Related U.S. Application Data

[63] Continuation-in-part of Ser. No. 889,672, May 28, 1992, Pat. No. 5,199,534, which is a continuation-in-part of Ser. No. 709,588, Jun. 3, 1991, Pat. No. 5,146,814.

[51] Int. Cl.[5] ..... B25B 13/06

[52] U.S. Cl. ..... 81/125

[58] Field of Search ..... 81/125

[56] References Cited

U.S. PATENT DOCUMENTS

| | | | |
|---|---|---|---|
| 2,491,089 | 12/1949 | Cowpen . | |
| 2,551,553 | 5/1951 | Wahl . | |
| 2,624,223 | 1/1953 | Clark . | |
| 2,750,828 | 6/1956 | Wenping . | |
| 2,793,552 | 5/1957 | Clark . | |
| 2,806,396 | 9/1957 | Miller | 87/125 |
| 3,288,002 | 11/1966 | Mankovitz . | |
| 3,320,563 | 5/1967 | Clark . | |
| 3,392,767 | 7/1968 | Stillwagon . | |
| 3,630,108 | 12/1971 | Stillwagon . | |
| 3,707,894 | 1/1973 | Stillwagon . | |
| 3,731,722 | 5/1973 | Carr . | |
| 3,808,918 | 5/1974 | Carr . | |
| 3,869,945 | 3/1975 | Zerver | 81/128 |
| 4,663,998 | 5/1987 | Parsons et al. . | |

*Primary Examiner*—James G. Smith

*Attorney, Agent, or Firm*—L. Meroy Lillehaugen; Alan D. Kamrath

[57] ABSTRACT

An accessory (10) for a wrench socket (12) is disclosed including a generally cylindrical magnet (32) secured to a generally cylindrical, nonmagnetic, compressible disk (26, 126). The disk (26, 126) has a shape having at least a portion (52) extending over the inner periphery of the well (14) of the socket (12) and is deformable under force to pass into and snuggly fit within the well (14) and magnetically insulate the magnet (32) from the socket (12). The magnet (32) has a size smaller than the well (14) and is secured to the disk (26, 126) generally concentrically within the well (14), with an air space being created between the magnet (32) and the well (14) for magnetically insulating the magnet (32) from the socket (12) in the most preferred form. The accessory (10) is removably insertable into the socket (12) of any design and model and without need for modification of the socket (12) and captures a fastener (16) slideably received in the well (14) of the socket (12) to magnetically hold the fastener (16) captive in the well (14) as the socket (12) is moved to the fastening location while not magnetizing the socket (12) or the fastener (16) sufficiently to be detrimentally magnetically attracted to metal adjacent to the fastening location. In preferred forms, the magnet (32) is received in a recess (46) formed in the disk (26, 126). In a further preferred form, the disk (126) further includes a second portion (54) of a size smaller than the first portion (52) for receipt in a connection passage (58) located intermediate the well (14) and the handle mounting end of the socket (12) and which is especially advantageous for sockets (12) having shallow depth wells (14).

20 Claims, 3 Drawing Sheets

MAGNETIC KEEPER ACCESSORY FOR WRENCH SOCKETS

CROSS REFERENCE

The present application is a continuation-in-part of application Ser. No. 07/889,672 filed May 28, 1992, now U.S. Pat. No. 5,199,334, which in turn is a continuation-in-part of application Ser. No. 07/709,588 filed Jun. 3, 1991, now U.S. Pat. No. 5,146,814.

BACKGROUND

The present invention relates generally to accessories for tools for initially holding fasteners thereto, and particularly to accessories for wrench sockets for initially holding fasteners captive therein.

While installing fasteners, it is often desirable to maintain the fastener with the tool until fastening is initially underway. Often it was necessary to hold the fastener relative to the tool with one hand while the tool was manipulated with the other hand. Because of limitations in space, access to the fastener by the hand holding the fastener and also by the tool itself was difficult if not impossible. Furthermore, due to the proximity of the hand to the fastener and the tool, the hand initially holding the fastener to the tool was especially prone to accidental injury. Thus, there is a well known need in the art for methods for temporarily holding the fastener to the tool until the fastening is initially underway.

Prior to the present invention, several methods have been devised for the use of magnetic forces to retain fasteners to the tool during fastening or removal of the fasteners. However, acceptance of such prior approaches in the art has been limited due to the inherent deficiencies in such prior approaches. For example, many of such approaches required specially manufactured and designed tools to incorporate the fastener retention feature and thus could not be utilized when the fastener retention feature was not desired and could not be utilized with standard tools already in use. Further, many of such approaches magnetized the entire tool so that the tool was not only magnetically attracted to the fastener but also to any metal in the path of the tool to the fastening location as well as metal surrounding the fastening location. Furthermore, many of such approaches were of complicated, multipiece designs incapable of being economically manufactured and assembled. Thus, a continuing need exists for accessories which can be selectively utilized with conventional wrench sockets without modification thereto and which capture fasteners in the well of the socket.

It is thus an object of the present invention to provide a novel accessory for use in a wrench socket without need for modifying the wrench socket and for preventing fasteners from sliding from the well of the socket to hold the fastener captive in the well while the socket is being moved to the fastening location and while the fastener is being initially fastened. In this regard, such a tool will be especially helpful in assembling or disassembling goods in hard-to-get-at fastening locations and at greater efficiencies. Further, as many accidents happen when working in such hard-to-get-at fastening locations, the accessory will reduce the exposure of injury to the user's hand which was otherwise required to hold the fastener in the wrench socket. Furthermore, the accessory will reduce the chance of injury due to sharp threads cutting fingers holding the fastener while trying to initially thread such fasteners. Likewise, the accessory will allow persons having handicaps or other disabilities to utilize wrench sockets in fastening situations which they otherwise were unable to perform.

It is further an object of the present invention to provide such a novel accessory which captures the fastener in the well of the socket but also does not magnetize the socket or the fastener captured therein to such a degree to cause detrimental attraction of the socket and the fastener to metal surrounding the fastening location. For example, the socket and fastener will not be attracted to the metal block of an engine as it is moved adjacent thereto to the fastening location. In this regard, the accessory will increase efficiency and productivity. Specifically, the fastener is captured in the socket in a desired position and will not change orientation and/or fall therefrom due to gravitational forces. Thus, fasteners are easier to start with one hand operation, which is particularly desirable for use with pneumatic or electric speed wrenches.

SUMMARY

Suprisingly, the above objectives can be satisfied in the field of wrench sockets by providing, in the preferred form, an insert accessory for use in a conventional wrench socket without modification. The accessory includes a magnet secured to a nonmagnetic, compressible disk. The disk is deformable under force to pass into and snuggly fit within the well of the socket and magnetically insulates the magnet from the socket. The magnet is smaller than the well of the socket and is held by the disk generally concentric within the well of the socket creating a magnetically insulating air space between the magnet and the socket.

In other aspects of the present invention, the magnet is held in a recess of the nonmagnetic, compressible disk without requiring the use of glue or adhesive by having at least a portion of the recess of an increased cross-sectional size than the cross-sectional size of the recess at the face of the disk which receives a complementary sized and shaped magnet periphery.

In further aspects of the present invention, the nonmagnetic, compressible disk has first and second portions integrally attached together, with the periphery of the second portion being smaller than the periphery of the first portion and for receipt in the connection passage of the socket located intermediate the well and the handle mounting end.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
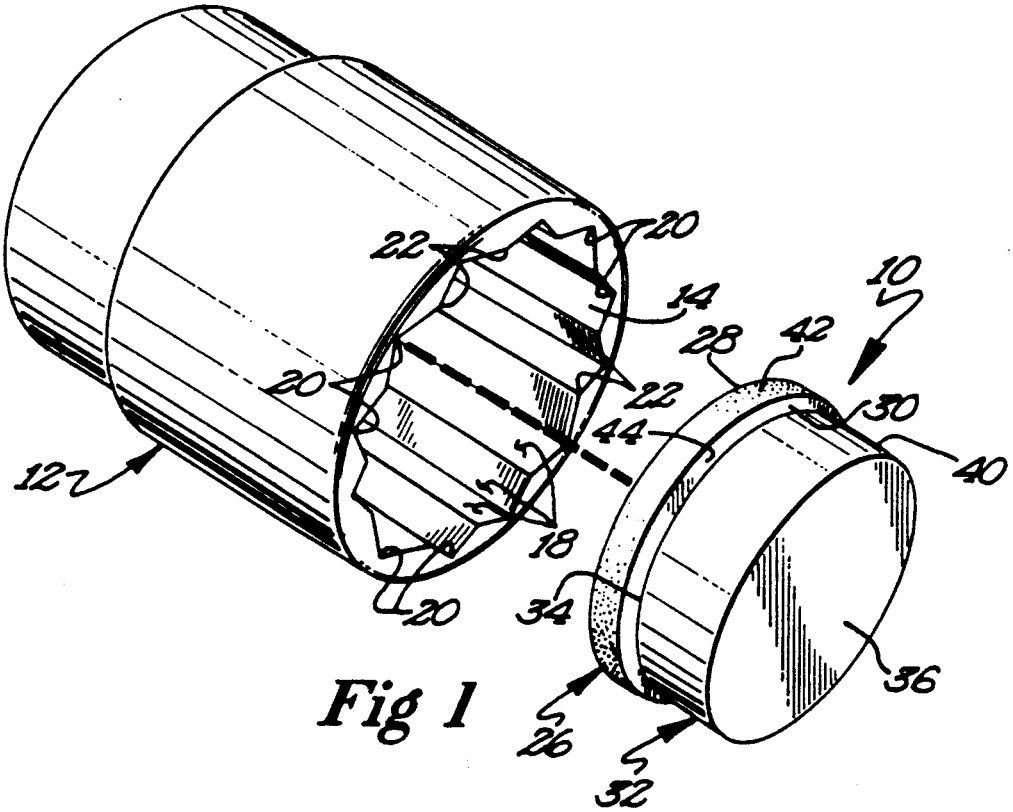
FIG. 1 shows an exploded perspective view of a fastener-keeping accessory for wrench sockets according to the preferred teachings of the present invention.
Figure 2:
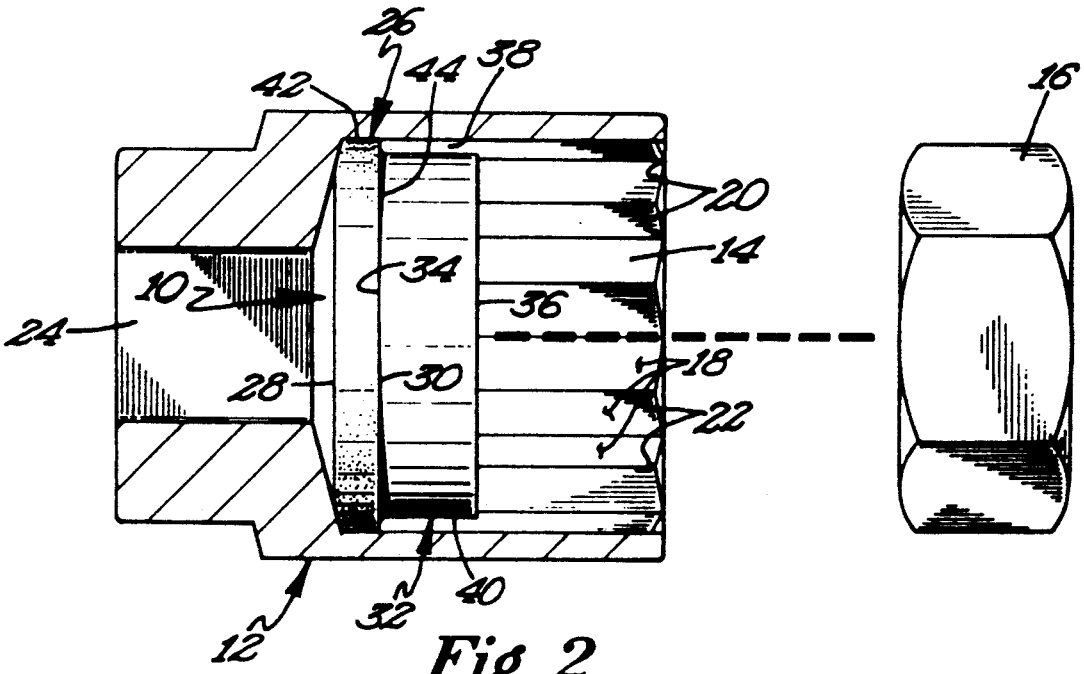
FIG. 2 shows a cross-sectional view of the fastener-keeping accessory of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inside", "outside", "inner", "outer", and similar terms are used herein, it should be understood that these terms have reference only to the structure shown in the drawings as it would appear to a person viewing the drawings and are utilized only to facilitate describing the invention.

DESCRIPTION

An accessory for temporarily holding or keeping fasteners such as burrs or bolts captive with respect to a tool according to the preferred teachings of the present invention is shown in the drawings and generally designated 10. In the most preferred form, accessory 10 is utilized in conjunction with a tool in the form of a wrench socket 12. Socket 12 can be any standard design generally including a well 14 having a multisided periphery sized to axially slideably receive the corresponding sized head of a bolt, a burr, or like fastener 16 without allowing rotation of burr 16 relative thereto. Specifically, the outer ends of sides 18 forming well 14 intersect at corners 20 arranged at a diameter generally equal to the corners of burr 16 and the inner ends of sides 18 forming well 14 intersect at corners 22 arranged at a diameter less than the diameter of corners 20 or the corners of burr 16. Opposite well 14, socket 12 includes a handle mounting end including a noncircular opening 24 for slideably receiving a complementary shaped shank of any conventional wrench handle.

In the preferred forms shown in FIGS. 1–5, accessory 10 includes a disk 26 of uniform thickness having planar, parallel, opposed faces 28 and 30. Disk 26 is generally cylindrical in shape and has a diameter greater than the diameter of corners 22 and in the most preferred form, generally equal to or slightly smaller than the diameter of corners 20. Disk 26 is formed of rubber or other suitable resilient, compressible, and nonmagnetic material of a flexible nature to allow disk 26 to be forced into well 14 with the outer periphery deforming to pass around corners 22 and snuggly fit within well 14. Further, the fit of disk 26 should be such that disk 26 can be forced from well 14 by passing an elongated member through opening 24 and pushing against face 28 but preventing disk 26 from being shaken out of well 14 even after repeated insertions and removals from well 14.

Accessory 10 further includes a magnet 32 which in the preferred form is a ceramic magnet. However, for accessory 10 to be utilized in sockets 12 having wells 14 for receipt of relatively small fasteners 16 (i.e. having cross sectional sizes of 5/16 inch (0.8 cm.) or smaller), magnet 32 may be formed of rare earth elements due to the limited size requirements and/or due to magnetic strength requirements. In the preferred form, magnet 32 is of uniform thickness having planar, parallel, opposed faces 34 and 36. Further, magnet 32 is generally cylindrical in shape and has a diameter less than disk 26 and less than the diameter of corners 22 of well 14.

Figure 3:
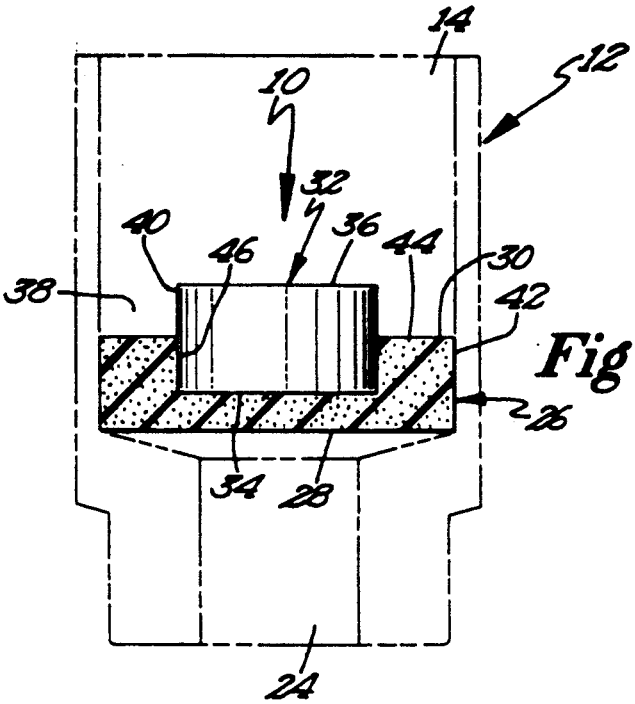
FIGS. 3-5 show cross-sectional views of alternate embodiments of a fastener-keeping accessory for wrench sockets according to the preferred teachings of the present invention.
Figure 4:
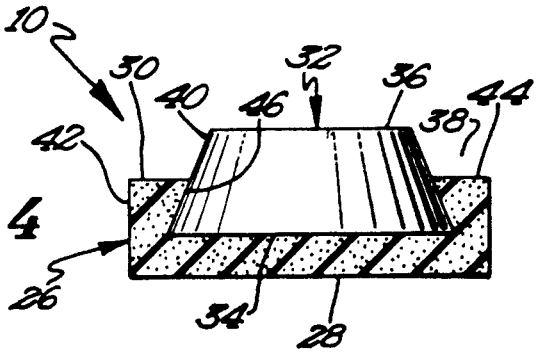
Figure 5:
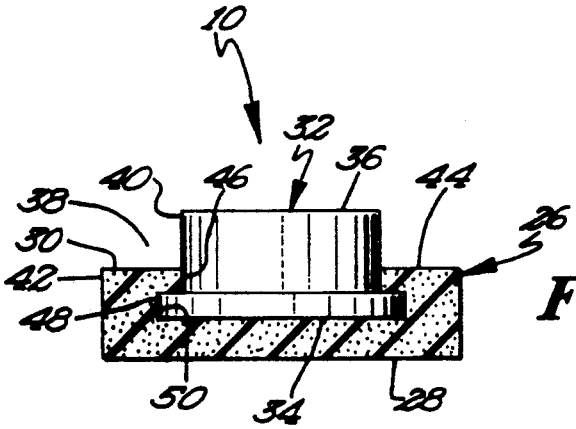

Magnet 32 is permanently secured to disk 26 by any suitable means with face 36 of magnet 32 being spaced from face 30 of disk 26 and the periphery 40 of magnet 32 being spaced from the periphery 42 of disk 26 with an annular portion 44 of face 30 of disk 26 extending beyond periphery 40 of magnet 32 according to the preferred teachings of the present invention. In a first preferred form shown in FIGS. 1 and 2, magnet 32 is glued or otherwise permanently secured to disk 26 with faces 30 and 34 in an abutting relation and with magnet 32 having a cylindrical periphery 40 and positioned generally concentrically on disk 26. In alternate preferred forms shown in FIGS. 3–5, disk 26 includes a recess 46 extending at a depth from face 30 towards but spaced from face 28 and spaced from periphery 42. Recess 46 has a size and shape for slideable receipt of periphery 40 of magnet 32. The depth of recess 46 is less than the height of magnet 32 between faces 34 and 36 and the height of disk 26 between faces 28 and 30. In the form shown in FIG. 3, periphery 40 of magnet 32 and recess 46 are in the shape of a cylinder, with magnet 32 preferably glued, adhered, or otherwise permanently secured to disk 26 within recess 46. The preferred form shown in FIG. 3 is especially advantageous for small size sockets 12 (i.e. having wells 14 for receipt of fastener 16 having a cross sectional size of 5/16 inch (0.8 cm.) or smaller) wherein face 34 of magnet 32 alone may not provide sufficient surface area to insure securement if necessary by glue or adhesive to disk 26. In the forms shown in FIGS. 4 and 5, recess 46 has at least a portion of an increased cross-sectional size than the cross-sectional size of recess 46 at face 30 of disk 26, with periphery 40 of magnet 32 having a complementary size and shape to recess 46 for holding magnet 32 in recess 46 without requiring the use of glue or adhesive. Specifically, periphery 40 of magnet 32 and recess 46 of accessory 10 of the preferred form shown in FIG. 4 are tapered and particularly are frusto-conical shaped. The increasing cross-sectional size and shape of magnet 32 from face 36 to face 34 received in the complementary and corresponding increasing size and shape of recess 46 from face 30 towards face 28 secures magnet 32 to disk 26 without requiring the use of glue or adhesive. In the preferred form shown in FIG. 5, periphery 40 of magnet 32 is generally cylindrical shaped and includes an integral annular lip 48 having a height less than the height of magnet 32 and less than the depth of recess 46, with the lower face of annular lip 48 extending contiguously with face 34 in the most preferred form. Similarly, recess 46 includes an undercut 50 of a size and shape for slideable receipt of lip 48 and located in disk 26 spaced from face 30. With lip 48 received in undercut 50, magnet 32 is secured to disk 26 without requiring the use of glue or adhesive. It should be appreciated that due to the flexible nature of disk 26, disk 26 can be deformed to allow the slideable receipt of magnet 32 in recess 46 in the forms shown in FIGS. 4 and 5 during manufacture of accessory 10 but generally holds magnet 32 securely to disk 26 under normal usage of accessory 10. Alternately, disk 26 can be formed around magnet 32, with magnet 32 forming and defining recess 46 in the manufacturing process according to the teachings of the present invention.

Figure 6:
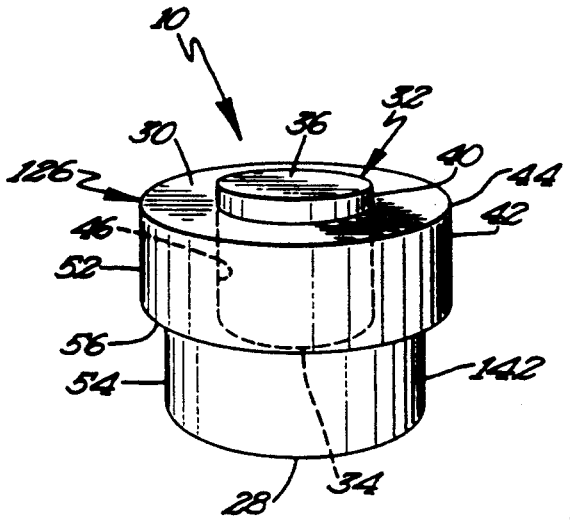
FIG. 6 shows a perspective view of an alternate embodiment of a fastener-keeping accessory for wrench sockets according to the preferred teachings of the present invention.
Figure 7:
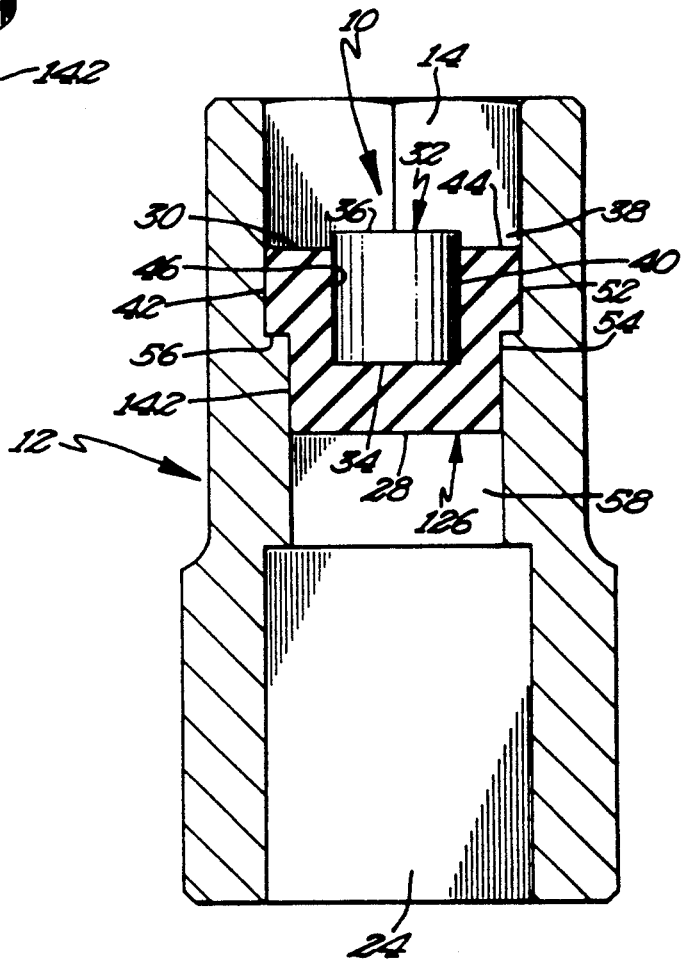
FIG. 7 shows a cross-sectional view of the fastener-keeping accessory of FIG. 6.

In the alternate form shown in FIGS. 6 and 7, disk 126 has planar, parallel, opposed faces 28 and 30 and is generally cylindrical in shape. Disk 126 includes a first cylindrical portion 52 integrally attached to a second cylindrical portion 54. Portion 52 includes face 30 and has periphery 42 having a diameter greater than the diameter of corners 22 and in the most preferred form, generally equal to or slightly smaller than the diameter of corners 20. Portion 54 includes face 28 and has a periphery 142 having a diameter less than portion 52. Portion 54 is arranged concentrically with portion 52 with a shoulder 56 being formed by portion 52 extending radially beyond portion 54 at their interconnection. Disk 126 is formed of rubber or other suitable resilient, compressible, and nonmagnetic material of a flexible nature to allow portion 52 to be forced into well 14 with periphery 42 deforming to pass around corners 22 and snuggly fit within well 14. Further, the fit of portion 52 should be such that disk 126 can be forced from well 14 by passing an elongated member through opening 24 and pushing against face 28 but preventing disk 126 from being shaken out of well 14 even after repeated insertions and removals from well 14.

Magnet 32 is permanently secured to disk 126 by any suitable means with face 36 of magnet 32 being spaced from face 30 of disk 26 and periphery 40 of magnet 32 being spaced from peripheries 42 and 142 of disk 126 with annular portion 44 of face 30 of disk 26 extending beyond periphery 40 of magnet 32 according to the preferred teachings of the present invention. In the preferred form shown in FIGS. 6 and 7, disk 126 includes recess 46 extending at a depth from face 30 towards but spaced from face 28 and spaced from peripheries 42 and 142. Recess 46 has a size and shape for slideable receipt of periphery 40 of magnet 32. The depth of recess 46 is less than the height of magnet 32 between faces 34 and 36 and the height of disk 126 between faces 28 and 30 but greater than the height of portion 52 from face 30 to shoulder 56. In the form shown in FIG. 3, periphery 40 of magnet 32 and recess 46 are in the shape of a cylinder, with magnet 32 preferably glued, adhered, or otherwise permanently secured to disk 126 within recess 46.

Now that the basic construction of accessory 10 according to the preferred teachings of the present invention has been explained, the operation and subtle features of accessory 10 can be set forth and appreciated. Specifically, when it is desired to initially hold burr 16 captive within well 14 of socket 12, accessory 10 can be positioned adjacent the open end of well 14 with periphery 42 of disk 26 or 126 extending over the inner periphery of well 14 and abutting with socket 12. At that time, accessory 10 can be pushed forcing disk 26 or 126 to deform and pass into well 14. Accessory 10 can be pushed into well 14 until face 28 is adjacent to or abuts with the handle mounting end and closes off the inner end of opening 24 of socket 12.

Due to the concentric mounting of magnet 32 relative to disk 26 or 126 and the smaller diameter of magnet 32 than well 14, an annular air space 38 will be created between periphery 40 of magnet 32 and well 14. It can then be appreciated that socket 12 is magnetically insulated from magnet 32 by disk 26 or 126 and air space 38. Specifically, due to the nonmagnetic material forming disk 26 or 126, disk 26 or 126 effectively prevents passage of the magnetic field of magnet 32 to the handle mounting end of socket 12. Likewise, due to the general inability of magnetic fields from passing through air, air space 38 effectively prevents magnetizing socket 12 between magnet 32 and well 14. Thus, although burr 16 positioned within well 14 and abutting with face 36 of magnet 32 will be attracted to and held by magnet 32 within well 14 of socket 12, the magnetic field created within socket 12 itself and the captured burr 16 will not be sufficient to be detrimentally attracted to any metal in the path of socket 12 to the fastening location as well as metal surrounding the fastening location.

Due to the magnetic insulation on all sides of magnet 32 by disk 26 or 126 and air space 38 except for face 36, the magnetic attraction between burr 16 and face 36 is enhanced. Thus, the strength required for magnet 32 to effectively capture burr 16 within well 14 is minimized, with the attraction of socket 12 to metal also dependent on the strength of magnet 32 also being minimized.

It should be appreciated that sockets 12 are made by various manufacturers and are of various designs and configurations including with varying number of sides 18 forming well 14. However, as sockets 12 of whatever design must correspond to and slideably receive burrs 16 to be operable, the diameter of corners 20 must be generally standard and corresponding to that of burrs 16. Accessory 10 according to the teachings of the present invention takes advantage of this feature to allow use in conventional sockets 12 of whatever design and without modification. Specifically, disk 26 or 126 can be sized according to the diameter of corners 20 of the particular sized socket 12 for which accessory 10 is desired to be utilized. Disk 26 or 126 can then be pushed into well 14 of socket 12 deforming to match the periphery of well 14 regardless of the number of sides 18 or the diameter of corners 22 of the particular socket 12 which accessory 10 is to be utilized. In fact, as accessory 10 is bound in well 14 by disk 26 or 126 deforming around corners 22 and along sides 18, high tolerances are possible between the relationship between the diameters of disk 26 or 126 and corners 20 such that accessory 10 can be utilized through a range of socket sizes such as for generally corresponding standard American (inch) or metric sizes.

It should further be appreciated that some sockets 12 are manufactured with wells 14 of a shallow design and specifically do not extend the length of socket 12 to opening 24 but rather a connection tunnel or passage 58 is provided intermediate well 14 and opening 24. Passage 58 can have a variety of shapes but has a diameter less than well 14 and typically larger than opening 24. Sockets 12 of the type having such a connection passage 58 are commonly used in small size sockets 12 (i.e. having wells 14 for receipt of fasteners 16 having a cross sectional size of ½ inch (1.26 cm) or smaller) as well as by some manufacturers for larger size sockets 12. It should be understood that magnets 32 have to have a minimum mass to have sufficient strength to magnetically hold fastener 16 in well 14. Additionally, the diameter of recess 46 must be smaller than the periphery of disc 26 or 126 to insure sufficient material exists between periphery 40 of magnet 32 and well 14 to magnetically isolate magnet 32 from socket 12 and reduce shock and stress transference to magnet 12. With shallow wells 14, accessory 10 utilizing disk 26 may not allow sufficient room to remain in well 14 to receive fastener 16 without slippage or release. Accessory 10 utilizing disk 126 is then particularly advantageous for use in sockets 12 having shallow wells 14. Particularly, periphery 142 has a size and shape corresponding to and for receipt in connection passage 58 and preferably for slideable receipt in connection passage 58 with a snug fit to assist portion 52 in holding accessory 10 within socket 12 while still allowing accessory 10 to be forced from socket 12 by passing an elongated member through opening 24 and pushing against face 28. However, periphery 142 can be smaller than connection passage 58. Disk 126 can then be pushed into well 14 with face 28 extending into connection passage 58 until shoulder 56 abuts with the end of well 14 and its interconnection to connection passage 58. It can then be appreciated that face 34 of magnet 32 is located in connection passage 58 below well 14. Thus, face 36 of magnet 32 is located deeper in well 14 leaving more room for receipt of fastener 16 in sockets 12 having shallow depths. Additionally, magnet 32 and recess 46 in disk 126 can be made with smaller diameters and longer in length to insure that the radial thickness of disk 126 is sufficient to magnetically isolate magnet 32 from socket 12 and to increase the surface area of recess 46 which engages magnet 32 to reduce shock and stress transference to magnet 32. It can be appreciated that in the event that accessory 10 having disk 126 is utilized in sockets 12 having deep wells 14 of the type shown in FIGS. 2 and 3 and specifically typically not including connection passage 58, disk 126 is pushed in well 14 until face 28 abuts with opening 24 in a similar manner as when disk 26 is utilized.

Further, in addition to being usable with any make or model of socket 12 without need for modifying socket 12, accessory 10 can be removed easily from socket 12 by pushing an elongated member through opening 24 thereby forcing accessory 10 from socket 12 and allowing standard use of socket 12. Due to the compressible nature of disk 26 or 126, accessory 10 can be inserted into and removed from well 14 a multiplicity of times without detrimentally affecting the utilization of accessory 10.

Furthermore, in addition to removably positioning magnet 32 into and magnetically insulating magnet 32 from socket 12, disk 26 or 126 takes up and absorbs vibration resulting from use of pneumatic tools in applying torque to socket 12 to fasten or loosen burr 16.

In the most preferred form, accessory 10 has a thickness such that burr 16 or the head of a bolt or similar fastener of a standard size extends beyond well 14 and out of socket 12 such as in the range of one-sixteenth inch (1.6 millimeters) to allow ease of removal of burr 16 from well 14 while still insuring that burr 16 extends sufficiently in well 14 to prevent relative rotation therebetween. Additionally, due to the deformable, snug fit, accessory 10 is slideably adjustable inside of well 14 to positions spaced from the handle mounting end of socket 12 so that burr 16 or similar fastener of a thinner size extends beyond well 14 and out of socket 12 to allow ease of removal of burr 16 from well 14. Specifically, accessory 10 can be adjustably positioned in well 14 by passing an elongated member through opening 24 and pushing against face 28 to slide accessory 10 to the desired position inside of well 14.

Although the operation of accessory 10 of the above invention was described with reference to a nut or burr 16, it can be appreciated that accessory 10 can be utilized to capture the head of a bolt or other fasteners within well 14 of socket 12. Likewise, although the operation of accessory 10 of the above invention was described with reference to fastening fastener 16, it can be appreciated that accessory 10 can be utilized to capture fastener 16 when removing fastener 16 from the fastening location.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Accessory for use in a wrench socket without need for modifying the wrench socket, with the wrench socket being of a conventional design including a well having an inner periphery formed by multiple sides intersecting at outer corners and including a handle mounting end, with the well slideably receiving a fastener, with the accessory preventing the fastener from sliding from the well to hold the fastener captive in the well while the socket is being moved to the fastening location, comprising, in combination: a nonmagnetic, compressible disk having planar, parallel, opposed, first and second faces and having first and second portions integrally attached together, with the first portion including a periphery of a size greater than the inner periphery of the well, with the second portion including a periphery smaller than the periphery of the first portion and than the inner periphery of the well, with the compressible disk having a recess extending at a depth from the second face of the disk towards but spaced from the first face of the disk and spaced from the peripheries of the first and second portions of the disk; and a generally cylindrical magnet having planar, parallel, opposed, first and second faces and a periphery smaller than the inner periphery of the well and of the peripheries of the first and second portions of the disk, with the depth of the recess being less than the height between the first and second faces of the magnet, with the recess having a size and shape for slideable receipt of the magnet for securing the magnet to the disk, with the magnet being secured to the disk with the second face of the magnet being spaced from the second face of the disk and the periphery of the magnet being spaced from the periphery of the disk with an annular portion of the second face of the disk extending beyond the periphery of the magnet, with the first portion of the disk being deformable under force to pass into and snuggly fit within the inner periphery of the well with the magnet positioned on the opposite side of the disk than the handle mounting end of the socket with the disk magnetically insulating the magnet from the socket and with the magnet positioned generally concentrically within the inner periphery of the well creating an air space between the inner periphery of the well and the periphery of the magnet for magnetically insulating the magnet from the socket.

2. The accessory of claim 1 wherein the socket includes a connection passage located intermediate the well and the handle mounting end; and wherein the periphery of the second portion is received in the connection passage when the first portion is deformed to snuggly fit within the well of the socket.

3. The accessory of claim 2 wherein the disk is formed of rubber.

4. The accessory of claim 3 wherein each of the first and second portions of the disk has a generally cylindrical shape.

5. The accessory of claim 4 wherein the disk is removable from the inner periphery of the well.

6. The accessory of claim 1 wherein the first portion of the disk has a thickness; and wherein the depth of the recess is greater than the thickness of the first portion.

7. The accessory of claim 1 wherein the second portion of the disk has a generally cylindrical shape.

8. Accessory for use in a wrench socket without need for modifying the wrench socket, with the wrench socket being of a conventional design including a well having an inner periphery formed by multiple sides intersecting at outer corners and including a handle mounting end, with the well slideably receiving a fastener, with the accessory preventing the fastener from sliding from the well to hold the fastener captive in the well while the socket is being moved to the fastening location, comprising, in combination: a nonmagnetic, compressible disk having planar, parallel, opposed, first and second faces and having first and second portions integrally attached together, with the first portion including a periphery of a size greater than the inner periphery of the well, with the second portion including a periphery smaller than the periphery of the first portion and than the inner periphery of the well, with the compressible disk having a recess extending at a depth from the second face of the disk towards but spaced from the first face of the disk and spaced from the peripheries of the first and second portions of the disk; and a generally cylindrical magnet having planar, parallel, opposed, first and second faces and a periphery smaller than the inner periphery of the well and the peripheries of the first and second portions of the disk, with the first portion of the disk being deformable under force to pass into and snuggly fit within the inner periphery of the well with the magnet positioned on the opposite side of the disk than the handle mounting end of the socket with the disk magnetically insulating the magnet from the socket and with the magnet positioned generally concentrically within the inner periphery of the well.

9. The accessory of claim 8 wherein the socket includes a connection passage located intermediate the well and the handle mounting end; and wherein the periphery of the second portion is received in the connection passage when the first portion is deformed to snuggly fit within the well of the socket.

10. The accessory of claim 9 wherein the periphery of the second portion is slideably received in the connection passage with a tight fit.

11. The accessory of claim 10 wherein the disk is formed of rubber.

12. The accessory of claim 11 wherein each of the first and second portions of the disk has a generally cylindrical shape.

13. The accessory of claim 12 wherein the disk is removable from the inner periphery of the well.

14. The accessory of claim 8 wherein the second portion of the disk has a generally cylindrical shape.

15. The accessory of claim 10 wherein the first portion of the disk has a thickness; and wherein the depth of the recess is greater than the thickness of the first portion.

16. The accessory of claim 8 wherein the first portion of the disk has a thickness; and wherein the depth of the recess is greater than the thickness of the first portion.

17. Tool for a fastener comprising, in combination: a wrench socket including a well having an inner periphery formed by multiple sides intersecting at outer corners and including a handle mounting end, with the well slideably receiving the fastener; and an accessory for preventing the fastener from sliding from the well to hold the fastener captive in the well while the socket is being moved to the fastening location, with the accessory comprising, in combination: a nonmagnetic, compressible disk having planar, parallel, opposed, first and second faces and having first and second portions integrally attached together, with the first portion including a periphery of a size greater than the inner periphery of the well, with the second portion including a periphery smaller than the periphery of the first portion and than the inner periphery of the well, with the compressible disk having a recess extending at a depth from the second face of the disk towards but spaced from the first face of the disk and spaced from the peripheries of the first and second portions of the disk; and a generally cylindrical magnet having planar, parallel, opposed, first and second faces and a periphery smaller than the inner periphery of the well and of the peripheries of the first and second portions of the disk, with the depth of the recess being less than the height between the first and second faces of the magnet, with the recess having a size and shape for slideable receipt of the magnet for securing the magnet to the disk, with the magnet being secured to the disk with the second face of the magnet spaced from the second face of the disk, with the first portion of the disk being deformable under force to pass into and snuggly fit within the inner periphery of the well with the magnet positioned on the opposite side of the disk than the handle mounting end of the socket with the disk magnetically insulating the magnet from the socket and with the magnet positioned generally concentrically within the inner periphery of the well creating an air space between the inner periphery of the well and the periphery of the magnet for magnetically insulating the magnet from the socket and without need to modify the wrench socket.

18. The accessory of claim 17 wherein the socket includes a connection passage located intermediate the well and the handle mounting end; and wherein the periphery of the second portion is received in the connection passage when the first portion is deformed to snuggly fit within the well of the socket.

19. The accessory of claim 18 wherein the first portion of the disk has a thickness; and wherein the depth of the recess is greater than the thickness of the first portion.

20. The accessory of claim 17 wherein the first portion of the disk has a thickness; and wherein the depth of the recess is greater than the thickness of the first portion.

* * * * *